United States Patent [19]

Schermerhorn et al.

[11] 4,099,097

[45] Jul. 4, 1978

[54] DRIVING AND ADDRESSING CIRCUITRY FOR GAS DISCHARGE DISPLAY/MEMORY PANELS

[75] Inventors: Jerry D. Schermerhorn, Swanton, Ohio; Hiram G. Slottow, Urbana, Ill.

[73] Assignee: Owens-Illinois, Inc., Toledo, Ohio

[21] Appl. No.: 702,114

[22] Filed: Jul. 2, 1976

[51] Int. Cl.[2] ..... H05B 37/00

[52] U.S. Cl. ..... 315/169 TV; 340/166 EL; 340/324 M; 340/343

[58] Field of Search ..... 315/169 R, 169 TV; 340/166 EL, 324 M, 343

[56] References Cited

U.S. PATENT DOCUMENTS

| | | | |
|---|---|---|---|
| 3,840,779 | 10/1974 | Schermerhorn | 315/169 TV X |
| 3,851,210 | 11/1974 | Schermerhorn | 315/169 TV X |
| 3,851,212 | 11/1974 | Umeda et al. | 315/169 TV |
| 3,908,151 | 9/1975 | Schermerhorn | 315/169 TV |
| 4,011,558 | 3/1977 | Sharpless | 315/169 TV X |

*Primary Examiner*—T.H. Tubbesing

*Attorney, Agent, or Firm*—David H. Wilson

[57] ABSTRACT

A driving and addressing circuit for applying sustaining, writing and erasing voltages to the cells of a multicelled gas discharge display/memory panel. The voltage generating circuitry is isolated from the panel by a pair of diodes individual to each electrode in the panel. Only the sustainer circuits and the diodes carry the relatively high sustainer currents so that the addressing circuits can be high impedance, low current devices. Switching means is provided between the electrodes and a diode clamp to limit the voltage applied to the cell to the maximum sustainer potential when the switching means is turned on. The switching means is turned off during the "write" addressing to allow the voltage applied to the cell to exceed the sustainer potential. In one embodiment, the switching means comprises a pair of switches, each one connected to all of the electrodes in one electrode array. In another embodiment, a single switch is connected to all the electrodes in one electrode array.

6 Claims, 6 Drawing Figures

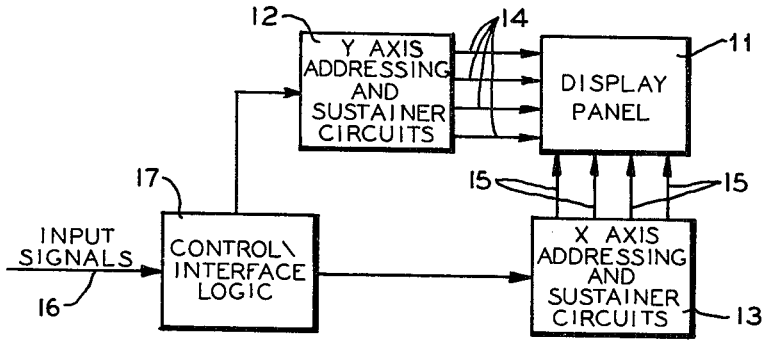

FIG. 1

| CIRCUIT | TIME BEFORE t0 | t0-t1 | t1-t2 | t2-t3 | t3-t4 | WRITE t4-t5 | t5-t6 | ERASE t6-t7 |
|---|---|---|---|---|---|---|---|---|
| 31 | ON | ON | OFF | OFF | ON | ON | OFF | OFF |
| 32 | OFF | OFF | OFF | ON | OFF | OFF | OFF | ON |
| 33 | OFF | OFF | ON | OFF | OFF | OFF | ON | OFF |
| 48 | OFF | ON | OFF | OFF | OFF | ON / OFF / ON | OFF | OFF |
| 73 | OFF | OFF | OFF | OFF | OFF | OFF / ON / OFF | OFF | OFF / ON / OFF |
| 54 | OFF | OFF | ON | ON | OFF | OFF | ON | ON |
| 56 | OFF | ON | OFF | OFF | OFF | ON | OFF | OFF |
| 58 | ON | OFF | OFF | OFF | ON | OFF | OFF | OFF |
| 64 | OFF | ON | OFF | OFF | OFF | ON / OFF / ON | OFF | OFF |
| 77 | OFF | OFF | OFF | OFF | OFF | OFF / ON / OFF | OFF | OFF / ON / OFF |
| 81 | OFF | OFF | OFF | OFF | OFF | OFF | OFF | ON |

FIG. 4

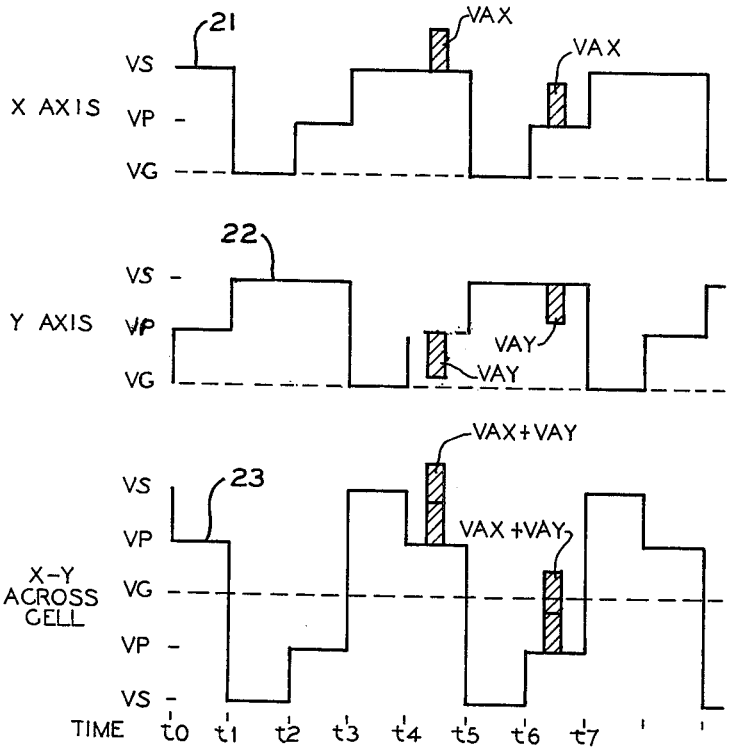

FIG. 3

DRIVING AND ADDRESSING CIRCUITRY FOR GAS DISCHARGE DISPLAY/MEMORY PANELS

BACKGROUND OF THE INVENTION

1. Field of the Invention

This invention relates to circuits for controlling gas discharge devices, especially multiple gas discharge display/memory devices which have an electrical memory and which are capable of producing a visual display or representation of data.

2. Description of the Prior Art

Heretofore, multiple gas discharge display and/or memory panels have been proposed in the form of a pair of dielectric charge storage members which are backed by electrodes, the electrodes being so formed and oriented with respect to an ionizable gaseous medium as to define a plurality of discrete gas discharge units or cells. The cells have been defined by a surrounding or confining physical structure such as the walls of apertures in a perforated glass plate sandwiched between glass surfaces and they have been defined in an open space between glass or other dielectric backed with conductive electrode surfaces by appropriate choices of the gaseous medium, its pressure and the electrode geometry. In either structure, charges (electrons and ions) produced upon ionization of the gas volume of a selected discharge cell, when proper alternating operating voltages are applied between the opposed electrodes, are collected upon the surface of the dielectric at specifically defined locations. These charges constitute an electrical field opposing the electrical field which created them so as to reduce the voltage and terminate the discharge for the remainder of the cycle portion during which the discharge producing polarity remains applied. These collected charges aid an applied voltage of the polarity opposite that which created them in the initiation of a discharge by imposing a total voltage across the gas sufficient to again initiate a discharge and a collection of charges. This repetitive and alternating charge collection and ionization discharge constitutes an electrical memory.

An example of a panel structure containing non-physically isolated or open discharge cells is disclosed in U.S. Pat. No. 3,499,167 issued to Theodore C. Baker, et al. Physically isolated cells have been disclosed in the article by D.L. Bitzer and H.G. Slottow entitled "The Plasma Display Panel—A Digitally Addressable Display With Inherent Memory" Proceeding of the Fall Joint Computer Conference, I E E E , San Francisco, Calif., November 1966, pp 541–457 and in U.S. Pat. No. 3,599,190.

One construction of a memory/display panel includes a continuous volume of ionizable gas confined between a pair of dielectric surfaces backed by conductor arrays, typically in parallel lines with the arrays of lines orthogonally related, to define in the region of the projected intersections as viewed along the common perpendicular to each array, a plurality of opposed pairs of charge storage areas on the surfaces of the dielectric bounding or confining the gas. Many variations of the individual conductor form, the array form, their relationship to each other and to the dielectric and gas are available, hence the orthogonally related, parallel line arrays which are discussed herein are merely illustrative.

In prior art, a wide variety of gases and gas mixtures have been utilized as the ionizable gaseous medium, it being desirable that the gas provide a copious supply of charges during discharge, be inert to the materials with which it came in contact and, where a visual display is desired, be one which produces a visible light or radiation which stimulates a phosphor. Preferred embodiments of the display panel have utilized at least one rare gas, more preferably at least two, selected from helium, neon, argon, krypton or xenon.

In the operation of the display/memory device an alternating voltage is applied, typically, by applying a first periodic voltage wave form to one array and applying a cooperating second wave form, frequently identical to and shifted on the time axis with respect to the first wave form, to the opposed array to impose a voltage across the cells formed by the opposed arrays of electrodes which is the algebraic sum of the first and second wave forms. The cells have a voltage at which a discharge is initiated. That voltage can be derived from an externally applied voltage or a combination of wall charge potential and an externally applied voltage. Ordinarily, the entire cell array is excited by an alternating voltage which, by itself, is of insufficient magnitude to ignite gas discharges in any of the elements. When the walls are appropriately charged, as by means of a previous discharge, the voltage applied across the element will be augmented, and a new discharge will be ignited. Electrons and ions again flow to the dielectric walls extinguishing the discharge. However, on the following half cycle, their resultant wall charges again augment the applied external voltage and cause a discharge in the opposite direction. The sequence of electrical discharges is sustained by an alternating voltage signal that, by itself, could not initiate that sequence.

In addition to the sustaining voltage, there are manipulating voltages or addressing voltages imposed on the opposed electrodes of a selected cell or cells to alter the state of those cells selectively. One such voltage, termed a "writing voltage," transfers a cell or discharge site from the quiescent to the discharging state by virtue of a total applied voltage across the cell sufficient to make it probable that on subsequent sustaining voltage half cycles the cell will be in the "on state." A cell in the "on state" can be manipulated by an addressing voltage, termed an "erase voltage," which transfers it to the "off state" by imposing sufficient voltage to draw off the surface or wall charges on the cell walls and cause them to discharge without being collected on the opposite cell walls in an amount such that succeeding sustainer voltage transitions are not augmented sufficiently by wall charges to ignite discharges.

A common method of producing writing voltages is to superimpose voltage pulses on a sustainer wave form in an aiding direction and cumulatively with the sustainer voltage, the combination having a potential of enough magnitude to fire an "off state" cell into the "on state." Erase voltages are produced by superimposing voltage pulses on a sustainer wave form in opposition to the sustainer voltage to develop a potential sufficient to cause a discharge in an "on state" cell and draw the charges from the dielectric surfaces such that the cell will be in the "off state." The wall voltage of a discharged cell is termed an "off state wall voltage" and frequently is midway between the extreme magnitude limits of the sustainer voltage.

The stability characteristics and non-linear switching properties of these bistable cells are such that, in the case of a cell which has not fired in the preceding half cycle of sustaining voltage, the state of such cell in the cell array can be changed by selective application of an external voltage which exceeds the firing or discharge igniting potential. In the case of a cell which has been fired in the preceding half cycle and has accumulated charges which can aid the sustaining voltage, the cell can be turned off by applying a voltage which discharges the cell. These manipulating signals are applied in a timed relationship with the alternating sustaining voltage, and through control of discharge intensity, accomplish selective state transitions by changing the wall voltage of only the cell being addressed.

Cells are transferred to the "on state" by applying a portion of the manipulating signal superimposed on the sustaining voltage, termed a "select signal," on each of two opposed electrode portions which are proximate the cell. Conventionally, like sustaining signals are imposed on each electrode array so that half the sustaining voltage is imposed on each array and half the select signal is imposed on the addressed cell electrode in each electrode array at a time when the sum of the applied voltages is sufficient to ignite a discharge. Further, the partial select signals on each electrode are limited to a value which will not impose a firing potential across other cells defined by that electrode and not selected. A typical write signal for a cell is developed by applying half select voltages to the addressed electrodes of the cell to be placed in the "on state" at a time the sustaining voltages are developing a pedestal potential somewhat below the maximum sustaining voltage. Typically, a write signal is imposed on each opposed electrode portion of the cell during the terminal portion of a sustain voltage half cycle when any wall charging which may result from the prior sustainer transient is substantially completed. The manipulating signal thus ignites a single, and unique, cell at the intersection of the selected two opposed electrodes. This ignited discharge thus establishes the cell in the "on state" since a quantity of charge is stored in the cell such that, on each succeeding half cycle of the sustaining voltage, a gaseous discharge will be produced.

In order to erase a cell or transfer it from the "on state" to the "off state," the erase signal is imposed as a firing voltage which extends from the sustainer voltage toward and through the neutral wall charge voltage level. As for writing, the erase manipulation is facilitated if the sustaining voltage is at a pedestal level below the level providing the maximum applied voltage so that the erase partial select voltages are at a convenient level. Typically, an erase signal is imposed on each opposed electrode portion of the cell during the terminal portion of a sustain voltage half cycle, when the wall charging from the prior sustainer discharge is substantially completed, but preceding the next half cycle alternation by enough time so that the wall discharge of the selected cell is substantially stabilized.

Circuitry for sustaining voltages, and where employed, their pedestal, and for the manipulating voltages for writing and erasing individual cells can be quite extensive.

Transformer coupling of manipulating signals to the electrodes of multiple gas discharge display/memory devices has been disclosed in William E. Johnson et al. U.S. Pat. No. 3,618,071 for "Interfacing Circuitry and Method for Multiple-Discharge Gasous Display and/or Memory Panels" which issued Nov. 2, 1971. The coupling of individual electrodes in large arrays involving substantial numbers of electrodes is cumbersome and expensive. Accordingly, solid-state pulser circuits capable of feeding through the sustaining voltage were proposed as exemplified in William E. Johnson U.S. Pat. No. 3,611,296 of Oct. 5, 1971 for "Driving Circuitry For Gas Discharge Panel." Multiplexing of the signals to the electrodes in an array has been utilized employing combinations of diode and resistor pulsers to manipulate cell potentials as shown in U.S. Pat. No. 3,684,918 issued Aug. 15, 1972 to Larry J. Schmersal for "Gas Discharge Display/Memory Panels and Selection and Addressing Circuits Therefore."

SUMMARY OF THE INVENTION

A typical multiplexed addressing circuit includes a resistor-diode adder circuit connected to each electrode. The diode is poled so that when the same polarity voltage is applied to both the resistor and the diode, or when the return path through the diode is opened, a "write" or "erase" voltage pulse can be generated on the associated electrode. A second diode is connected to each electrode to provide a low impedance return path for the current. Therefore, during addressing the two diodes isolate the electrode from the other electrodes, but during sustaining they provide low impedance paths for current flow in both directions.

In the addressing circuitry, there are elements which must work with the relatively high sustainer currents supplied to all the electrodes and the addressing currents supplied to the resistors connected to the non-selected electrodes. Therefore, the multiplexed system cannot be easily formed in integrated circuits using metal oxide-semiconductor (MOS) or similar technology. However, the twin diode isolation retains the advantage of isolating the electrodes when addressing even when an individual low current electrode pulser is connected to each electrode in the panel.

In one embodiment of the present invention, an individual electrode pulser is connected to each electrode. Since the resistors are no longer required to perform a logic function as part of a resistor-diode adder circuit, they are eliminated thereby reducing the power required during the addressing operations. The electrode pulsers are required to supply only the displacement current for a single electrode and the discharge current for a single cell (or up to 16 cells for parallel addressing) so they can be formed in integrated circuits. As a result of the removal of the resistors, the rise time of the addressing pulse will be reduced. Also included in the prior art multiplexing system was a diode switch matrix which was utilized to provide a path for the displacement currents and to open the return path through the diode of the resistor-diode adder of the electrode selected for addressing. In the circuit of the present invention, the diode switch matrix is no longer utilized for multiplexing and has been replaced by an individual diode switch for each axis.

In an alternate embodiment, the impedance of the sustaining circuit is further reduced by replacing the two diode switches with a single switch connected in series with the diode clamp connected to the sustainer pull-up circuit power supply. During the sustaining and erase operations, the switch is closed to clamp the electrodes at the sustainer voltage level. During the write operation, the switch is open to allow the voltage on the electrode to rise above the sustainer level and generate a discharge.

It is an object of the present invention to provide a multicell gas discharge display/memory panel addressing circuit which can be easily formed in integrated circuits to reduce the cost of the panel operating system and the power requirements therefor.

It is another object of the present invention to provide a gas discharge panel addressing circuit for reducing the address pulse rise time thereby reducing the address pulse duration.

It is a further object of the present invention to provide a gas discharge panel addressing circuit which reduces the power required during the addressing operations.

It is another object of the present invention to simplify the addressing circuit by eliminating the diode switch matrix and control circuits therefor.

BRIEF DESCRIPTION OF THE DRAWINGS

FIG. 1 is a block diagram of a multicelled gas discharge display/memory device and operating system therefor;

FIG. 3 is a wave form diagram of the sustainer wave form with "write" and "erase" pulses generated by the circuit of FIG. 2;

FIG. 4 is a table of switch states for the circuit of FIG. 2;

DESCRIPTION OF THE PREFERRED EMBODIMENT

Figure 2:
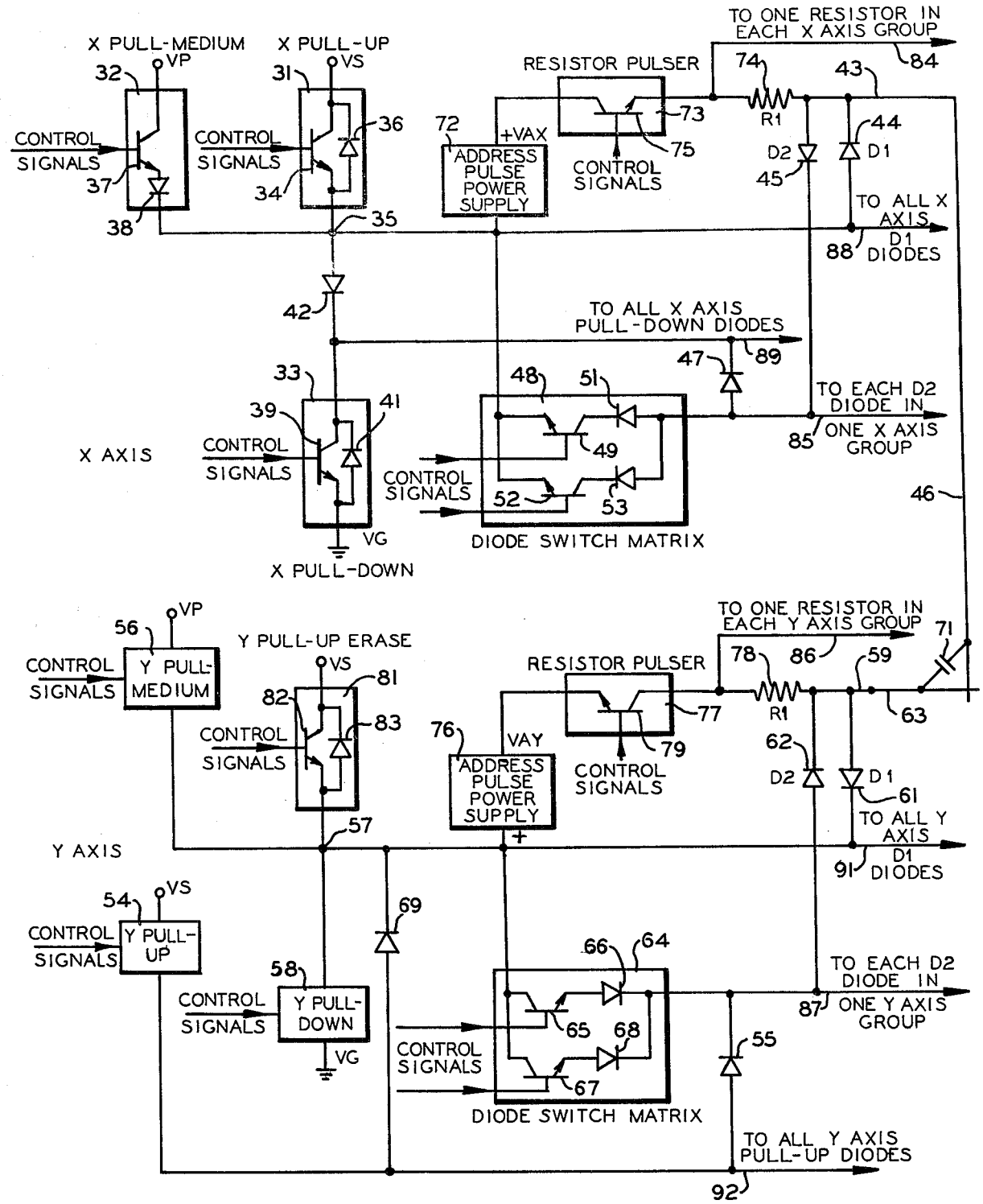
FIG. 2 (PRIOR ART)
FIG. 2 is a partial schematic, partial block diagram of a portion of prior art addressing and sustainer circuits.

There is shown in FIG. 1 a block diagram of a multicelled gas discharge display/memory device and operating system therefor to which the present invention is applicable. The device is represented as a display panel 11 which may be of the type disclosed in U.S. Pat. No. 3,499,167 issued to Theodore C. Baker et al. The panel 11 includes a pair of opposed electrode arrays (not shown) with proximate electrode portions of at least one electrode in each array defining the cells. Sustainer and addressing voltage waveforms are applied to the panel 11 to maintain and manipulate the discharge states of individual cells. The addressing and sustainer wave forms are generated by a pair of addressing and sustainer circuits, a Y axis circuit 12 and an X axis circuit 13, which are connected to the Y axis and X axis electrode arrays respectively. A plurality of leads 14 are representative of the interconnections between the Y axis circuit 12 and the Y axis electrodes of the panel 11 and a plurality of leads 15 are representative of similar interconnections on the X axis. The information to be displayed by the panel 11 is externally generated and applied as input signals on one or more input lines 16 to a control/interface logic circuit 17. The circuit 17 buffers and decodes the input signals to generate control signals to the circuits 12 and 13.

FIG. 2 is a partial schematic, partial block diagram of a portion of circuits similar to each of the circuits 12 and 13 in a prior art configuration for generating addressing and sustainer wave forms such as the wave forms shown in FIG. 3. During the normal sustainer operation, X and Y sustainer circuits impress sustainer wave forms on the X and Y electrode arrays respectively. As shown in FIG. 3, an X axis sustainer wave form 21 and a Y axis sustainer wave form 22 are combined to generate a composite sustainer wave form 23 which is applied to all of the cells in the panel 11. The X axis sustainer circuit includes three sustainer voltage circuits, an X pull-up circuit 31, an X pull-medium circuit 32 and an X pull-down circuit 33 for generating the X sustainer wave form 21. The X pull-up circuit 31 is connected to a sustainer voltage power supply (not shown) to receive a sustainer voltage VS. The circuit 31 is represented as an NPN transistor 34 having a collector connected to the VS power supply, a base connected to receive control signals from the control/interface logic circuit 17 of FIG. 1 and an emitter connected to a common junction 35 for the circuits 31, 32 and 33. A diode 36 has a cathode connected to the collector and an anode connected to the emitter of the transistor 34 to function as a diode clamp.

The X pull-medium circuit 32 is connected to a sustainer power supply (not shown) to receive a pedestal voltage VP of a magnitude intermediate the voltage VS and the voltage applied by the X pull-down circuit 33. The circuit 32 is represented by an NPN transistor 37 having a collector connected to the VP power supply, a base connected to receive control signals from the circuit 17 of FIG. 1 and an emitter connected to an anode of a diode 38 having a cathode connected to the common junction 35 for the circuits 31, 32 and 33. The X pull-down circuit 33 is connected to a sustainer power supply (not shown) to receive a ground voltage VG which is the neutral potential for the sustainer wave form. The circuit 33 is represented by an NPN transistor 39 having a collector connected to the common junction 35, a base connected to receive control signals from the circuit 17 of FIG. 1 and an emitter connected to the voltage VG. A diode 41 has a cathode connected to the collector of the transistor 39 and an anode connected to the emitter to function as a diode clamp. A diode 42 is connected between the circuit 33 and the common junction 35 with an anode connected to the common junction and a cathode connected to the collector of the transistor 39.

In FIG. 2 (and FIGS. 5 and 6), each electrode is connected to its own pair of isolation diodes designated D1 and D2. These diodes are oppositely poled to provide low impedance paths for the sustainer current flow and to isolate each electrode from the other electrodes in the panel during addressing.

The circuits 31, 32 and 33 are connected to an X axis lead 43 through a D1 diode 44 and a D2 diode 45. The D1 diode 44 has an anode connected to the common junction 35 and a cathode connected to the lead 43. The lead 43 can be a conductor on a flexible ribbon cable having one end connected to the addressing and sustainer circuits and the other end connected to an exposed end of an electrode 46 of the panel, where the circuits are mounted remote from the panel, or can be the exposed end of the electrode where the circuits are mounted on the panel substrate surrounding the actual viewing area. The circuit 33 is connected to a cathode of a diode 47 having an anode connected to a cathode of the D2 diode 45 which has an anode connected to the lead 43. The sustainer circuits are individually enabled by the control signals to generate the X axis wave form 21 shown in FIG. 3 on the electrode 46 through the D1 diode 44 and the D2 diode 45. The sustainer circuits are also connected to the other X axis electrodes as will be discussed.

The D2 diode 45 has its cathode connected to one lead of a diode switch matrix 48. Another lead of the matrix 48 is connected to the common junction 35. A portion of the matrix 48 is represented as a pair of transistor switches connected in parallel. A first NPN transistor 49 has a collector connected to a cathode of a diode 51, a base connected to receive control signals from the circuit 17 of FIG. 1 and an emitter connected to the common junction 35. A second NPN transistor 52 has a collector connected to a cathode of a diode 53, a base connected to receive control signals from the circuit 17 of FIG. 1 and an emitter connected to the common junction 35. The diodes 51 and 53 each have a anode connected to the anode of the diode 47. The diode switch matrix 48 and a similar matrix for the Y axis also serve as multiplexing circuits for addressing the cells as will be subsequently discussed.

The Y axis also has sustainer circuits, similar to the circuits 31, 32 and 33, such as a Y pull-up circuit 54 connected between the VS power supply (not shown) and a diode 55, a Y pull-medium circuit 56 connected between the VP power supply (not shown) and a common junction 57 and a Y pull-down circuit 58 connected between the VG power supply (not shown) and the common junction 57. The circuits 54, 56 and 58 are connected to a Y axis lead 59, similar to the X axis lead 43, through a D1 diode 61 and a D2 diode 62. The D1 diode 61 has a cathode connected to the common junction 57 and an anode connected to the lead 59. The circuit 54 is connected to an anode of the diode 55 which has a cathode connected to an anode of the D2 diode 62 which has a cathode connected to the lead 59. The lead 59 is connected to an electrode 63 wherein the circuits are alternately enabled by control signals from the circuit 17 of FIG. 1 to generate the Y axis wave form 22 shown in FIG. 3 through the D1 diode 61 and the D2 diode 62. The sustainer circuits are also connected to all of the other Y axis electrodes, as will be discussed, to apply the Y axis sustainer wave form 22 to the Y axis electrode array.

The D2 diode 62 has its anode connected to one lead of a matrix 64. Another lead of the matrix 64 is connected to the common junction 57. A portion of the matrix is represented as a pair of transistor switches connected in parallel. A first NPN transistor 65 has a collector connected to the junction 57, a base connected to receive control signals from the circuit 17 of FIG. 1 and an emitter connected to an anode of a diode 66. A second NPN transistor 67 has a collector connected to the junction 57, a base connected to receive the control signals from the circuit 17 and an emitter connected to an anode of a diode 68. The diodes 66 and 68 each have a cathode connected to the anode of the D2 diode 62. The circuit 54 is also connected to the junction 57 through a diode 69 having an anode connected to the circuit 54 and a cathode connected to the junction 57.

The electrodes 46 and 63 have proximate portions which define a typical gas discharge cell 71. Assuming the initial conditions shown before time *t*0 in FIG. 3, the X pull-up circuit 31 is turned on to apply the VS voltage to the electrode 46 through the D1 diode 44 and the Y pull-down circuit 58 is turned on to apply the VG voltage to the electrode 63 through the D1 diode 61. At time *t*0, the circuit 58 is turned off and the Y pull-medium circuit 56 and the matrix 64 are turned on to connect the VP voltage to the electrode 63 through the D2 diode 62. Since the electrode 63 was at the VG voltage, the charge across the cell 71 must decrease which it cannot do instantaneously. The voltage on the electrode 46 is driven to VS + VP to reverse bias the diode 44. Therefore, the matrix 48 is turned on to provide a path for the displacement current which flows from the electrode 46, through the diode 45, through the matrix 48 and through the diode 36 to the VS power supply to partially discharge the cell to the new applied voltage shown as the portion of the sustain waveform 23 between *t*0 and *t*1 in FIG. 3.

Between the times *t*1 and *t*2, the X pull-down circuit 33 is turned on to connect the VG voltage to the electrode 46 through the D2 diode 45 and the diode 47. The D1 diode 44 is biased at VG by the circuit 33 through the diode 42. The Y pull-up circuit 54 is turned on to connect the VS voltage to the electrode 63 through the D2 diode 62 and the diode 55. Between the times *t*2 and *t*3, displacement current flows through the diode 38 as the circuit 32 is turned on to connect the VP voltage to the electrode 46 through the D1 diode 44 and the circuit 64 is turned on to connect the VS voltage to the electrode 63. Between the times *t*3 and *t*4, the X pull-up circuit 31 is turned on to connect the VS voltage to the electrode 46 through the D1 diode 44 and the Y pull-down circuit 58 is turned on to connect the VG voltage to the electrode 63 through the D1 diode 61. Between the times *t*0 and *t*4 a full cycle of the sustainer wave form 23 has been generated and the sequence of control signals is repeated to generate a train of such cycles. The status of each of the sustainer and matrix circuits is shown in the table of FIG. 4 wherein "on" designates that a transistor switch is closed and "off" designates that the switch is open.

It has been shown that the D1 and D2 diodes connected to each electrode provide low impedance paths for the sustainer current in both directions of flow. However, the D2 diodes also function as an electrode selection elements during the addressing of the cells. An X axis address pulse power supply 72 has one lead connected to the common junction 35 and the other lead connected to the lead 43 through a resistor pulser 73 and an R1 resistor 74 connected in series. The pulser 73 is represented by an NPN transistor 75 having a collector connected to the power supply 72, a base connected to receive control signals from the circuit 17 of FIG. 1 and an emitter connected to the R1 resistor 74. When the pulser 73 is turned on, the power supply 72 applies an address pulse voltage VAX to the electrode 46 through the R1 resistor 74. The polarity of the voltage VAX is such that VAX is added to the sustainer voltage which is generated at the junction 35.

A Y axis address pulse power supply 76 has one lead connected to the common junction 57 and the other lead connected to the lead 59 through a resistor pulser 77 and an R1 resistor 78 connected in series. The pulser 77 is represented by an NPN transistor 79 having a collector connected to the resistor 78, a base connected to receive control signals from the circuit 17 of FIG. 1 and an emitter connected to the power supply 76. When the pulser 77 is turned on, the power supply applies an address pulse voltage VAY to the electrode 63 through the R1 resistor 78. The polarity of the voltage VAY is such that VAY is subtracted from the sustainer voltage which is generated at the junction 57. The R1 resistor 74 and the D2 diode 45 and the R1 resistor 78 and the D2 diode 62 form a pair of resister-diode adder circuits.

If the pulsers 73 and 77 are turned on during the time period *t*4—*t*5, the voltage VAX will be added to the sustainer voltage VS and the voltage VAY will be subtracted from the sustianer voltage VP as shown in FIG. 3. The magnitudes of the voltages VAX and VAY are such that neither one alone in the time period *t4—t5* will generate a discharge in the cell 71, but together they are sufficient to write the cell. However, as shown in the table of FIG. 4, the diode switch matricies 48 and 64 are turned off during the time the pulsers 73 and 77 are turned on to block the return paths through the D2 diodes 45 and 62 so that the write addressing voltages are applied to the cell 71. If the pulsers 73 and 77 are turned on during the time period *t6—t7*, the voltage VAX will be added to the sustainer voltage VP and the voltage VAY will be subtracted from the sustainer voltage VS as shown in FIG. 3 to erase the cell 71. The diode switch matricies 48 and 64 are turned off during the time the pulsers 73 and 77 are turned on to block the return paths through the D2 diodes 47 and 63. A Y pull-up erase circuit 81 is provided to supply the VS voltage during the erase period. An NPN transistor 82 has a collector connected to the VS power supply, a base connected to receive control signals from circuit 17 of FIG. 1 and an emitter connected to the junction 57. A diode 83 has an anode connected to the emitter and cathode connected to the collector of the transistor 82 to function as a clamp. The circuit 81 is utilized during the erase period to generate a VS reference for the VAY voltage power supply 76 since the Y pull-up circuit 54 is isolated from the power supply 76 by several diodes (not shown).

Where the X and Y electrode arrays each include a large number of electrodes, some of the prior art circuts have utilized a multiplexing approach to addressing the cells. For example, both electrode arrays can be divided into groups of electrodes, each group containing the same number of electrodes. In FIG. 2 the resistor pulser 73 is connected to one electrode in each group through an R1 resistor for each electrode as illustrated by the R1 resistor 74 for the electrode 46. A line 84 is provided for connecting the pulser 73 to the other R1 resistors (not shown). Another portion of the multiplexing circuit is the D2 diode 45 and the matrix 48. The matrix 48 is connected to a D2 diode for each of the electrodes in one X axis group by a line 85. Each of the other groups is also provided with similar diode switches for multiplexing. When the pulser 73 is turned on, the matrix 48 is turned off and all other switches remain turned on such that VAX is dropped across each of the R1 resistors connected to the pulser 73 except the R1 resistor 74. Therefore, only the electrode 46 receives the VAX voltage. The Y axis electrodes are similarly connected in groups. The pulser 77 is connected to an R1 resistor in each group by a line 86. The matrix 64 is connected to each D2 diode in one group by a line 87. The matrix 64 is turned off when the pulser 77 is turned on so that only the electrode 63 receives the VAY voltage.

The sustainer wave forms are also applied to the other electrodes. The circuits 31 and 32 are connected to all of the X axis D1 diodes by a line 88. The circuit 33 is connected to all the D2 diodes through a pull-down diode for each group of electrodes similar to pull-down diode 47. a line 89 connects the circuit 33 to the other X axis pull-down diodes. The circuit 58 is connected to all of the Y axis D1 diodes by a line 91. The circuits 56 and 81 are connected all of the D2 diodes through diode switches such as the matrix 64. The circuit 54 is connected through a line 92 to all of the D2 diodes through a pull-up diode for each group of electrodes similar to the pull-up diode 55.

The pulsers 73 and 77 must supply high currents to the R1 resistors of the non-selected electrodes in each array. Therefore, the multiplexed system of FIG. 2 cannot easily be formed in intergrated circuits. The twin diode (D1 and D2) isolation however, retains advantages even when the multiplexed system is abandoned and individual integrated circuit pulsers are connected to each electrode. Since the R1 resistor no longer performs the logic function of dropping the address pulse voltage on non-selected lines, it can be replaced by a short circuit with the result that the rise time of the addressing pulse will be reduced. Furthermore, since the transistor switches in the matrixes no longer are required for multiplexing, they can be replaced by a single switch on each axis. Such a circuit is shown in FIG. 5.

Figure 5:
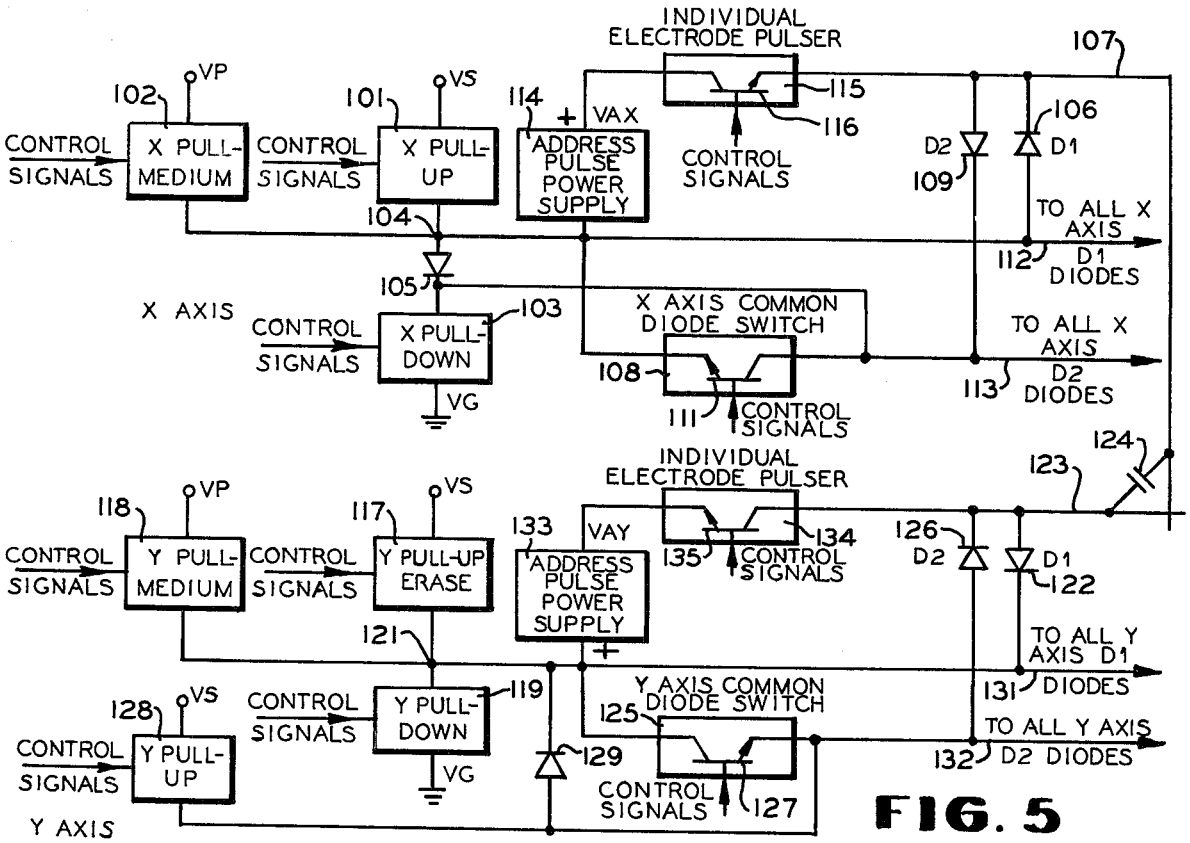
FIG. 5 is a partial schematic, partial block diagram of an addressing and sustainer circuit according to the present invention.

In FIG. 5, the X axis sustainer circuit includes an X pull-up circuit 101, an X pull-medium circuit 102 and an X pull-down circuit 103 connected to an common junction 104, the circuit 103 being connected to a cathode of a diode 105 having an anode connected to the junction 104. The circuits 101, 102 and 103 are similar to the circuits 31, 32 and 33 respectively of FIG. 2. The junction 104 is connected to an anode of a D1 diode 106 having a cathode connected to an X axis electrode 107. A single X axis diode switch 108 is connected between the junction 104 and a cathode of a D2 diode 109 having an anode connected to the electrode 107. The switch 108 is represented as a NPN transistor 111 having a collector connected to the D2 diode 109, a base connected to receive control signals from a circuit (not shown) similar to the circuit 17 of FIG. 1 and an emitter connected to the junction 104. The switch 111 is turned on to provide a path for the displacement current to the diode clamp (not shown) of the X pull-up circuit 101. The circuit 103 is connected to the cathode of the D2 diode 109 to allow the sustainer wave form current to bypass the switch 111. All of the X axis D1 diodes have their anodes connected to a line 112 to receive the VS and VP sustainer voltages and all of the X axis D2 diodes have their cathodes connected to a line 113 to receive the VG sustainer voltage. The line 113 is connected to the switch 108. An X axis address pulse power supply 114 has one lead connected to the common junction 104 and the other lead connected to the electrode 107 through an electrode pulser 115. The pulser 115 is represented by an NPN transistor 116 having a collector connected to the power supply 114, a base connected to receive control signals from a circuit (not shown) similar to the circuit 17 of FIG. 1 and an emitter connected to the electrode 107. When the pulser 115 is turned on, and the transister 111 is turned off an address pulse voltage VAX is applied to the electrode 107 which is added to the sustainer voltage generated at the junction 104.

The Y axis sustainer circuit includes a Y pull-up erase circuit 117, a Y pull-medium circuit 118 and a Y pull-down circuit 119 connected to a common junction 121. The circuits 117, 118 and 119 are similar to the circuits 81, 56 and 58 respectively of FIG. 2. The junction 121 is connected to a cathode of a D1 diode 122 having an anode connected to a Y axis electrode 123. The electrodes 107 and 123 have proximate portions which define a gas discharge cell 124. A single Y axis diode switch 125 is connected between the junction 121 and an anode of a D2 diode 126 having a cathode connected to the electrode 123. The switch 125 is represented as an NPN transistor 127 having a collector connected to the junction 121, a base connected to receive control signals from a circuit (not shown) similar to the circuit 17 of FIG. 1 and an emitter connected to the anode of the D2 diode 126. The switch 125 is turned on to provide a path for current from the circuit 118 when the VP portion of the sustainer wave form is generated. A Y pull-up circuit 128, similar to the circuit 54 of FIG. 2, is connected to the anode of the D2 diode 126 and to the junction 121 through a diode 129 having an anode connected to the circuit 128 and a cathode connected to the junction 121. All of the Y axis D1 diodes have their cathodes connected to a line 131 to receive the VG sustainer voltage and all of the Y axis D2 diodes have their anode connected to a line 132 to receive the VP and VS sustainer voltages. A Y axis address pulse power supply 133 has one lead connected to the common junction 121 and the other lead connected to the electrode 123 through an electrode pulser 134. The pulser 134 is represented by an NPN transistor 135 having a collector connected to the electrode 123, a base connected to receive control signals from a circuit (not shown) similar to the circuit 17 of FIG. 1 and an emitter connected to the power supply 133. When the pulser 134 is turned on, and the transistor 127 is turned off the power supply subtracts an address pulse voltage VAY from the sustainer voltage generated on the electrode 123.

Figure 6:
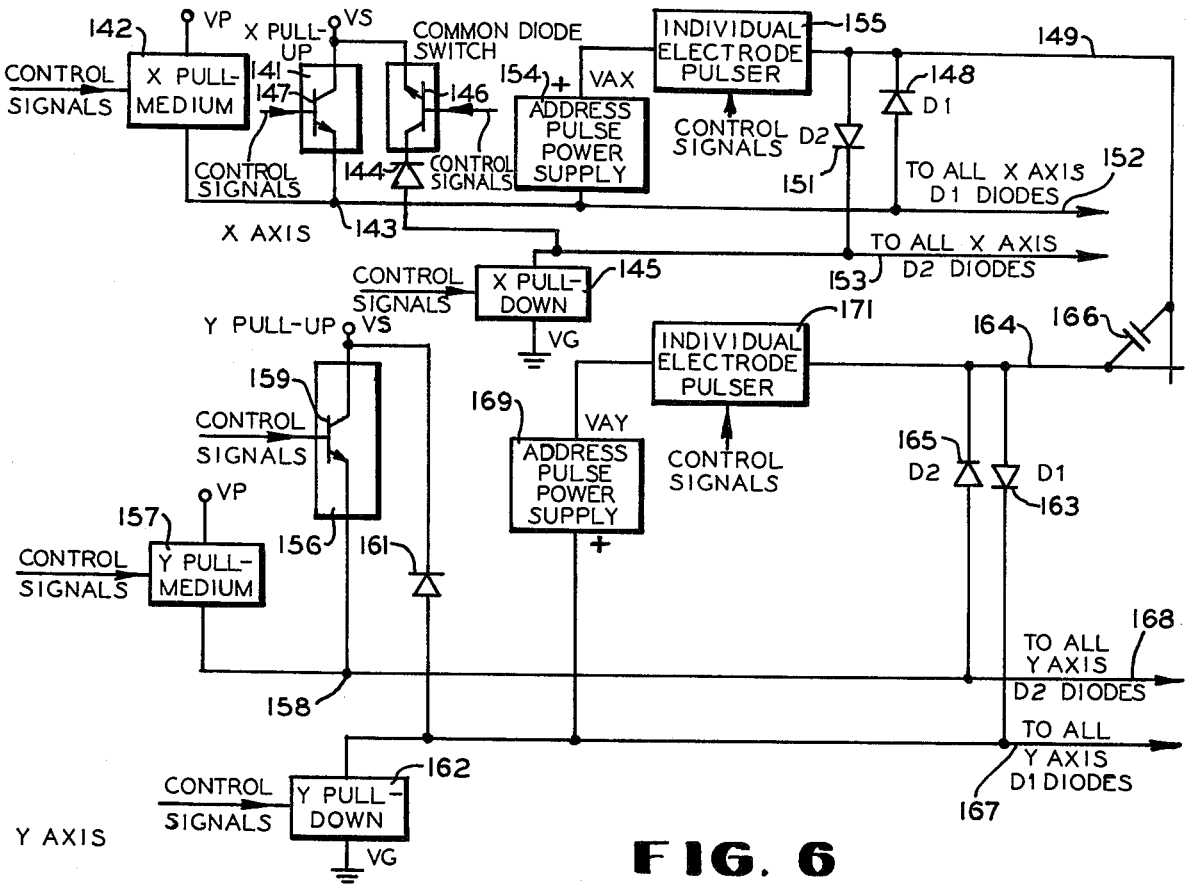
FIG. 6 is a partial schematic, partial block diagram of an alternate embodiment of the addressing and sustainer circuit of FIG. 5.

The impedance of the addressing and sustaining circuit, as seen by the panel cells, can be reduced further by removing the switches connected to the D2 diodes. There is shown in FIG. 6 a circuit in which the diode switches have been replaced. An X pull-up circuit 141 and an X pull-medium circuit 142 are connected to a common junction 143. The circuits 141 and 142 are similar to the circuits 31 and 32 of FIG. 2 except that the diode clamp 36 in the circuit 31 has been replaced by a diode 144 having an anode connected to an X pull-down circuit 145 and a cathode connected to the VS power supply (not shown) through an NPN transistor 146. The circuit 141 is represented by an NPN transistor 147 having a collector connected to the VS power supply, a base connected to receive control signals and an emitter connected to the junction 143. The transistor 146 has a collector connected to the cathode of the diode 144, a base connected to receive control signals and an emitter connected to the VS power supply. A D1 diode 148 has an anode connected to the junction 143 and a cathode connected to an electrode 149. The transistor 146 could also be connected between the diode 144 and the junction between pull down circuit 145 and the cathodes of all the D2 diodes.

The circuit 145 is connected to a cathode of a D2 diode 151 having an anode connected to the electrode 149. All of the other D1 diodes have their anodes connected to a line 152 to receive the VS and VP sustainer voltages and all of the other D2 diodes have their cathodes connected to a line 153 to receive the VG sustainer voltage. An X axis address pulse power supply 154 has one lead connected to the junction 143 and another lead connected to the electrode 149 through an electrode pulser 155 similar to the pulser 115 of FIG. 5 to generate the VAX pulse voltage on the electrode 149.

A Y pull-up circuit 156 and a Y pull-medium circuit 157 are connected to a common junction 158. The circuit 156 is represented by an NPN transistor 159 having a collector connected to the VS power supply, a base connected to receive control signals and an emitter connected to the junction 158. A clamping diode 161 has an anode connected to a Y pull-down circuit 162 and a cathode connected to the VS power supply. The circuit 162 is also connected to a cathode of a D1 diode 163 having an anode connected to an electrode 164. A D2 diode 165 has an anode connected to the junction 158 and a cathode connected to the electrode 164. Proximate portions of the electrodes 149 and 164 define a gas discharge cell 166. All of the other D1 diodes have their cathodes connected to a line 167 to receive the VG sustainer voltage and all of the other D2 diodes have their anodes connected to a line 168 to receive the VS and VP sustainer voltages. A Y axis address pulse power supply 169 has one lead connected to the circuit 162 and the other lead connected to the electrode 164 through an electrode pulser 171 to subtract the pulse voltage VAY from the sustainer voltage on the electrode 164.

The transistor 146 is normally turned on so that the diode 144 functions as a clamp at the VS voltage level. However, during the "write" period when the pulsers 155 and 171 are turned on, the transistor 146 is turned off to allow the voltage on the electrode 149 to rise above the VS level and fire the cell 166.

In summary, the present invention concerns an operating system for a multicelled gas discharge display/memory device wherein the device includes a pair of opposed electrode arrays with proximate portions of at least one electrode in each array defining the cells. A sustainer voltage source cyclically imposes a pulsating voltage having a period and a maximum potential VS across each of the cells. Individual electrode pulser means are connected to each of the electrodes for generating address voltage pulses to manipulate the discharge state of individual cells between on "on state" and an "off state."

The sustainer voltage source includes a pair of pull-up circuits each one of which is connected between a source of the maximum potential sustainer voltage VS and a respective electrode array and a pair of pull-down circuits each one of which is connected between a source of a reference voltage VG and a respective electrode array. The sustainer voltage source can also include a pair of pull-medium circuits each connected between a source of a pedestal voltage VP, having a magnitude between the magnitudes of the voltages VS and VG, and a respective electrode array. Typically, the voltage sources for the VS, VP and VG voltages are direct current power supplies which are alternately connected to the electrodes by the pull-up, pull-medium and pull-down circuits to generate the sustainer wave form.

Each electrode is isolated from all of the other electrodes by a twin diode isolation circuit for connecting the sustainer voltage source to the electrodes. The diode isolation circuit includes a plurality of first (D1) diodes and a plurality of second (D2) diodes. Each of the first diodes is connected between the sustaner source and a respective one of the electrodes to apply a sustainer voltage of one polarity as referenced from the cell neutral voltage to the cells and each of the second diodes is connected between the sustainer voltage source and a respective one of the electrodes to apply a sustainer voltage of the other polarity as referenced from the cell neutral voltage to the cells. The first and second diodes provide paths for displacement currents generated by the application of the sustainer voltages to the cells. A clamping diode is connected between the VS voltage source and all of the second diodes connected to one of the electrode arrays, said clamping diode providing a path for displacement currents generated by the application of the sustainer voltage to the cells. Switching means are connected between the VS voltage source and all of the second diodes connected to said one electrode array, the switching means being closed to maintain the displacement current path through the clamping diode during at least a portion of the sustainer voltage cycle and being closed to break the displacement current path through the clamping diode when the electrode pulser connected to the electrodes defining at least one of the cells is turned on to change the discharge state of the cell from the "off state" to the "on state."

In one embodiment of the invention, the switching means includes a first solid state switch connected between the clamping diode and all of the second diodes connected to the one electrode array. Typically, the switch is a transistor which is turned on to maintain the displacement current path and turned off to break the displacement current path. The switching means includes a second solid state switch connected between all of the second diodes connected to the other electrode array and a source of a sustainer voltage. Typically, the second switch is a transistor and the sustainer voltage to which it is connected can be either the maximum potential VS voltage or a VP voltage having a magnitude less than the magnitude of the VS voltage. The second switch is turned on to maintain the sustainer current path and turned off to break the sustainer current path.

In an alternate embodiment, the switching means includes a solid state switch connected in series with the clamping diode between the VS sustainer power supply and the second diodes. The switch is turned on to maintain the displacement current path and is turned off to break the displacement current path.

Although the circuits of FIGS. 2, 5 and 6 are shown as generating the wave form of FIG. 3 from voltage components each of which are one-half of the total sustainer amplitude, the present invention can also be utilized in circuits for generating a sustainer wave form from asymmetrical components. Asymmetrical sustainer component wave forms are shown in U.S. Pat. No. 3,840,779 issued to Jerry D. Schermerhorn on Oct. 8, 1974. As shown in the identified patent, the sustainer voltage components are referenced from a sustainer ground voltage which is not the neutral voltage for the cell, the neutral voltage being halfway between the sustainer voltage extremes. The displacement current path through the clamping diode still must be broken to allow the write address voltage to rise above the maximum voltage level to which the sustainer is clamped.

In accordance with the provisions of the patent statutes, the principle and mode of operation of the invention have been explained and illustrated in its preferred embodiment. However, it must be understood that the invention may be practiced otherwise than as specifically illustrated and described without departing from its spirit or scope.

What is claimed is:

1. In an operating system for a multicelled gas discharge display/memory device, the device including a pair of opposed spaced electrode arrays with proximate electrode portions of at least one electrode in each array defining the cells; an ionizable gas volume between the spaced electrode portions of each cell; a dielectric charge storage member in contact with the gas insulating at least one electrode portion of each cell from the gas; a plurality of electrode pulser means for generating address voltage pulses to manipulate the discharge state of individual cells between an "on state" and an "off state," each one of the plurality of electrode pulser means being connected to a respective one of the electrodes of the electrode arrays; a sustainer voltage source for cyclically imposing a pulsating voltage having a period and a predetermined maximum potential across each of the cells, the sustainer voltage source including a pull-up circuit which is connected between a source for the maximum potential sustainer voltage and a respective electrode array for applying the maximum potential sustainer voltage to the electrodes; a diode isolation circuit including a plurality of first diodes, each of the first diodes connected between the sustainer voltage source and a respective one of the electrodes to apply a sustainer voltage of one polarity as referenced from the cell neutral voltage to the cells and provide a path for the displacement currents generated thereby and a plurality of second diodes, each of the second diodes connected between the sustainer voltage source and a respective one of the electrodes and poled in a direction opposite the first diodes to apply a sustainer voltage of the other polarity as referenced from the cell neutral voltage to the cells and provide a path for the displacement currents generated thereby; and a clamping diode connected between the source of the maximum potential sustainer voltage and all of the second diodes connected to one of the electrode arrays, the clamping diode providing a path for the displacement current carried by the second diodes connected to the one electrode array, the improvement comprising:

switching means connected between the source of the maximum potential sustainer voltage and all of the second diodes connected to the one electrode array, said switching means being closed to maintain the displacement current path through the clamping diode during at least a portion of the sustainer voltage cycle and being open to break the displacement current path through the clamping diode when the electrode pulser connected to the electrodes defining at least one of the cells is turned on to change the discharge state of the cell from the "off state" to the "on state."

2. A system according to claim 1 wherein said switching means includes a first solid state switch connected between the clamping diode and all of the second diodes connected to the one electrode array, said first switch being turned on to maintain the displacement current path and being turned off to break the displacement current path.

3. A system according to claim 2 wherein said switching means includes a second solid state switch connected between all of the second diodes connected to the other electrode array and a source of a sustainer pedestal voltage having a potential which is smaller in magnitude than the maximum potential sustainer voltage, said second switch being turned on to maintain a sustainer current path and being turned off to break said sustainer current path.

4. A system according to claim 3 wherein said first and second switches are transistors.

5. A system according to claim 2 wherein said switching means includes a second solid state switch connected between all of the second diodes connected to the other electrode array and the maximum potential sustainer voltage source, said second switch being turned on to maintain the displacement current path and being turned off to break the displacement current path.

6. A system according to claim 1 wherein said switching means includes a solid state switch connected in series with the clamping diode, said switch being turned on to maintain the displacement current path and being turned off to break the displacement current path.

* * * * *